US005141078A

United States Patent [19]

Wood

[11] Patent Number: 5,141,078

[45] Date of Patent: Aug. 25, 1992

[54] SCAFFOLD DECK

[75] Inventor: Charles F. Wood, Mississauga, Canada

[73] Assignee: Aluma Systems Corp., Downsview, Canada

[21] Appl. No.: 774,333

[22] Filed: Oct. 10, 1991

[51] Int. Cl.[5] ..... E04G 1/15; E04G 5/08

[52] U.S. Cl. ..... 182/222; 182/119

[58] Field of Search ..... 182/222, 223, 228, 119

[56] References Cited

U.S. PATENT DOCUMENTS

| | | | |
|---|---|---|---|
| 4,499,967 | 2/1985 | Anderson | 182/222 |
| 4,561,165 | 12/1985 | Bayer | 182/222 |
| 4,802,553 | 2/1989 | Waters | 182/222 |
| 4,825,976 | 5/1989 | Wyse | 182/222 |
| 4,984,654 | 1/1991 | Anderson | 182/222 |

FOREIGN PATENT DOCUMENTS

| | | | |
|---|---|---|---|
| 3245126 | 6/1984 | Fed. Rep. of Germany | 182/222 |
| 660391 | 4/1987 | Switzerland | 182/222 |

*Primary Examiner*—Reinaldo P. Machado

[57] ABSTRACT

The present invention relates to a scaffold deck of simplified construction. The scaffold deck has two parallel side rails connected at the ends by means of parallel transom members. Hook members are provided at the junction of the transom and side rail members with the fasteners for each hook member commonly securing the respective transom and side rail. The side rails at the opposed interior edges include a substrate engaging slot extending in the length of the side rails and have an edge region beyond the substrate which forms part of the top working surface of the scaffold deck. The scaffold deck advantageously uses the side rails for forming an edge region of the scaffold deck whereby the amount of substrate between the side rails is reduced thereby reducing cost and improving the weight of the scaffold deck.

19 Claims, 4 Drawing Sheets

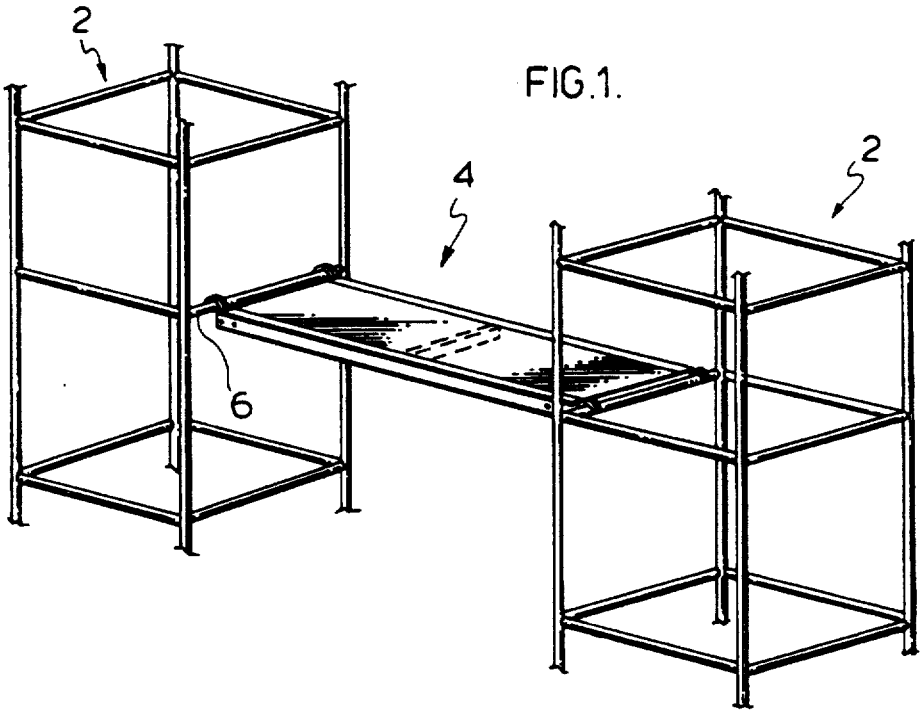
FIG. 1.
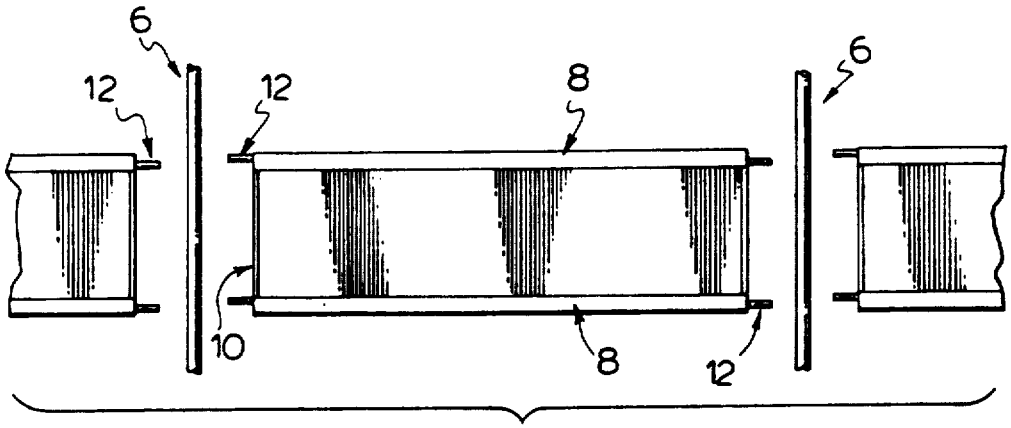
FIG. 2.
FIG. 3.
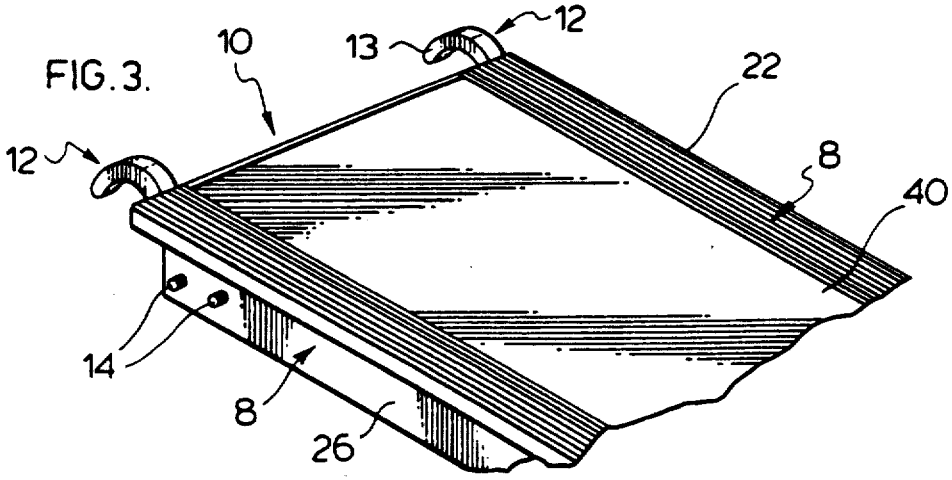

SCAFFOLD DECK

FIELD OF THE INVENTION

The present invention relates to scaffold decks or work platforms.

BACKGROUND OF THE INVENTION

A host of scaffold decks are known for forming of a work surface at different levels by supporting a platform between two horizontal members or rails of a scaffolding system. Originally, such scaffold decks were made entirely of wood and, more recently, the scaffold decks are made of a combination of aluminum structural members and a wood or plywood platform between such structural members. The side rails of the scaffold deck have provided a side edge for the plywood deck. Various arrangements have been proposed for securing of the hooks to the side rails and transom members. Typically, the hooks have been secured to these members independently of the connection between the side rails and transom.

It is important in a scaffold deck to provide a system which is light in weight, capable of withstanding damage during use, and which provides a safe working surface for a labourer.

SUMMARY OF THE INVENTION

A scaffold deck, according to the present invention, comprises two parallel extruded side rails connected at the ends by parallel transom members with hook members at the junction of each transom member and a side rail. The junction of a side rail and transom member and hook is maintained by means of fasteners which commonly secure the components. The side rail at the opposed interior edges include a substrate engaging slot offset from the center line of the side rail and extending in the length of the side rail and a substrate engaged by the slots extends between the side rails. The side rails beyond the substrate engaging slot include a top edge strip extending in the length of each side rail which, in combination with the engaged substrate, form the top surface of the scaffold deck.

According to an aspect of the invention, the scaffold deck has the top edge strip of each side rail modified with a raised surface to improve foot traction thereon.

According to a further aspect of the invention, the top surface of the side rail forms part of the slot for receiving the support substrate.

According to yet a further aspect of the invention, the transom member includes bolt engaging slots running the length of the transom member which receive and engage the common fasteners used to secure the side rail hook member and transom at each corner of the scaffold deck.

According to yet a further embodiment, each transom member includes at the upper edge thereof a raised lip for protecting and limiting movement of the substrate.

BRIEF DESCRIPTION OF THE DRAWINGS

Preferred embodiments of the invention are shown in the drawings wherein:

FIG. 1 is a perspective view showing a supported scaffold deck;

FIG. 2 is a top view showing how a series of scaffold decks can be commonly supported;

FIG. 3 is a partial perspective view showing one end of the scaffold deck;

DETAILED DESCRIPTION OF THE PREFERRED EMBODIMENTS

Figure 5:
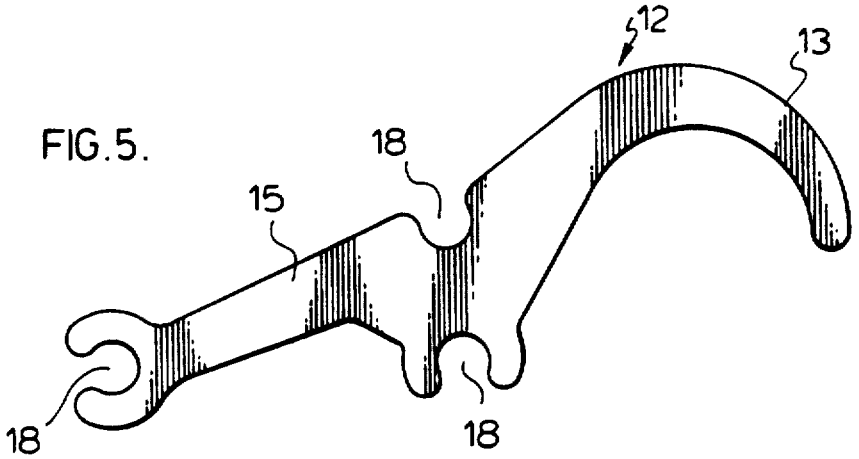
FIG. 5 is a side view of the hook member.

The scaffold deck, generally shown as 4 in the drawings, is supported by a scaffolding system 2 having horizontal members 6. Each scaffold deck 4 has opposed parallel side rails 8 connected at the ends thereof by means of transom members 10. Hook members 12 are secured at the junction of the side rails and transom members and are adapted to engage the horizontal members 8 of the scaffolding system 2. Bolt fasteners 14 are used to commonly secure the side rails 8, transom members 10 and hook members 12. The hook members 12, as shown in FIG. 5, have three securing ports 18 with the two opposed securing ports being alignable with bolt engaging and receiving slots 20 of the transom members 10. The side rails, at the ends thereof, include ports 16 for allowing the bolt fasteners 14 to pass therethrough and secure the respective side rail, transom member and hook member.

Figure 7:
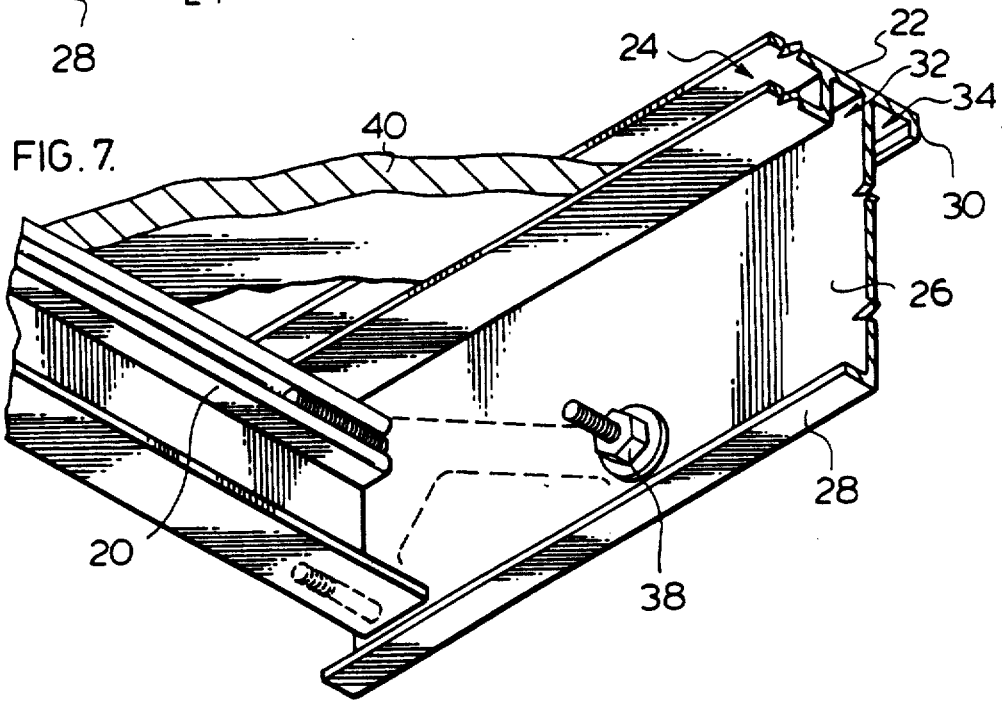
FIG. 7 is a bottom perspective view showing securement of the hook side rail and transom member.

The side rail 8, as shown in FIG. 7, has a top edge strip 22 which preferably has a number of raised edges running the length thereof to improve the foot traction thereon. A substrate receiving slot 24 is provided at the interior edge of the transom member 10 and preferably receives a sheet of plywood, shown as 40. The top edge strip 22 is of a substantial width with the width beyond the interior edge of the substrate being at least one inch and preferably one inch beyond the web.

Figure 4:
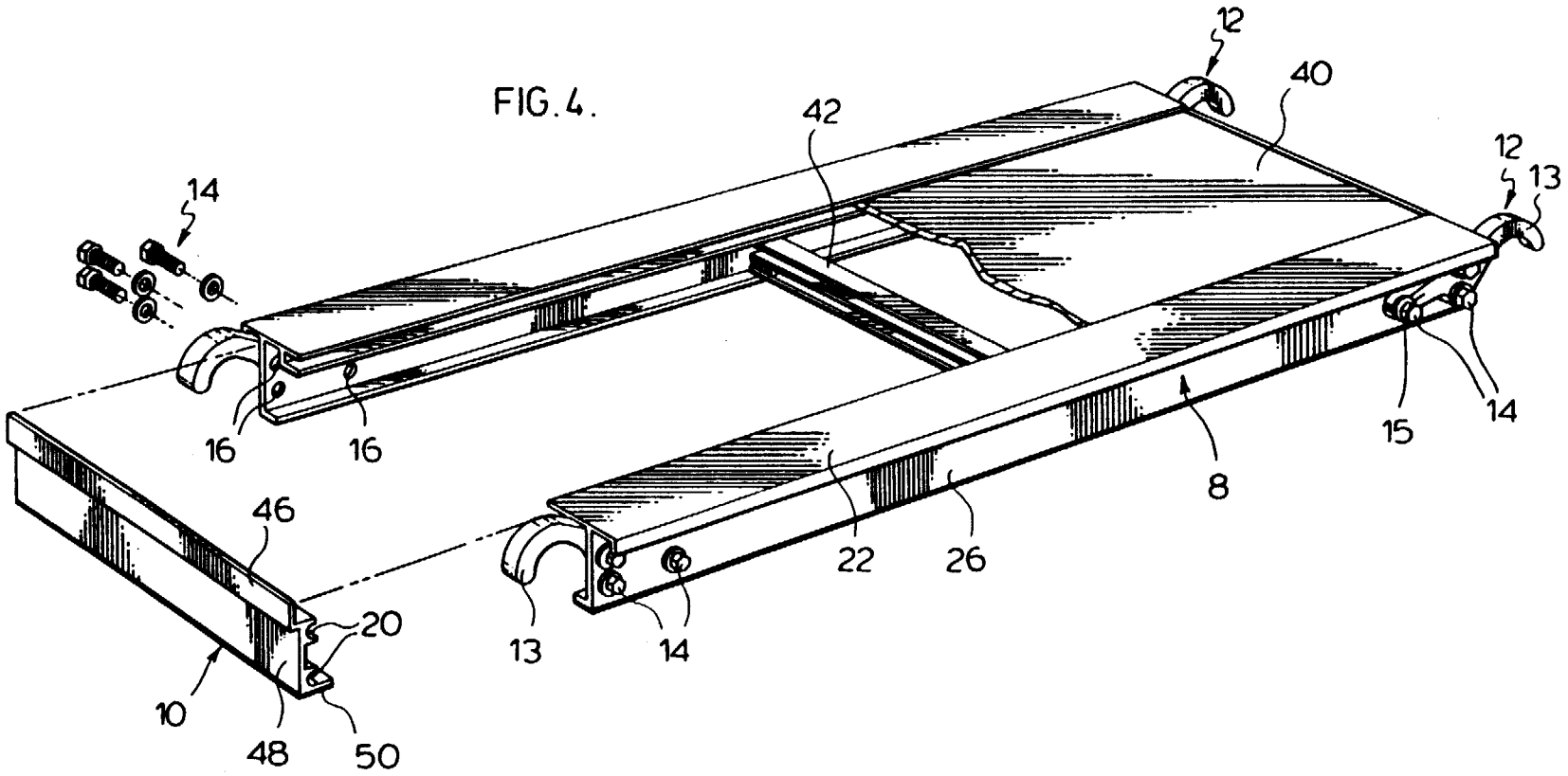
FIG. 4 is an exploded perspective view with a portion of the support substrate removed to show details of the scaffold deck.

The side rail includes a web 26 which is perpendicular to the top edge strip 22. The web at the lower edge thereof includes a bottom flange 28 and the top edge strip 22 includes a downwardly extending outer flange 30. Each of these flanges improve the structural strength of the side rail and also serve to protect these edges from damage during use of the scaffold deck. As can be seen in the section, a gap 32 is provided between the substrate receiving slot 24 and the web 26, which can accommodate the thickness of the hook member 12, and a slot 34 is provided to the exterior of the web between the web and the outer flange 34 for, again, receiving the thickness of the hook member 12. Thus, the hook member can be located interior to the edges of the side rails to either side of the web. It can also be seen in FIGS. 6 and 7 that the common fasteners, i.e. bolt fasteners 14, commonly secure the respective hook member, side rail and transom member. Two of the bolts are received in the bolt engaging and receiving slots 20 of the transom member and the third bolt passes through the hook and side rail at a position spaced from the transom member and can be secured by a nut 38. As shown in FIG. 4, an intermediate support member 42 can serve to interconnect the side rails and support the plywood 40 intermediate the side rails.

Figure 8:
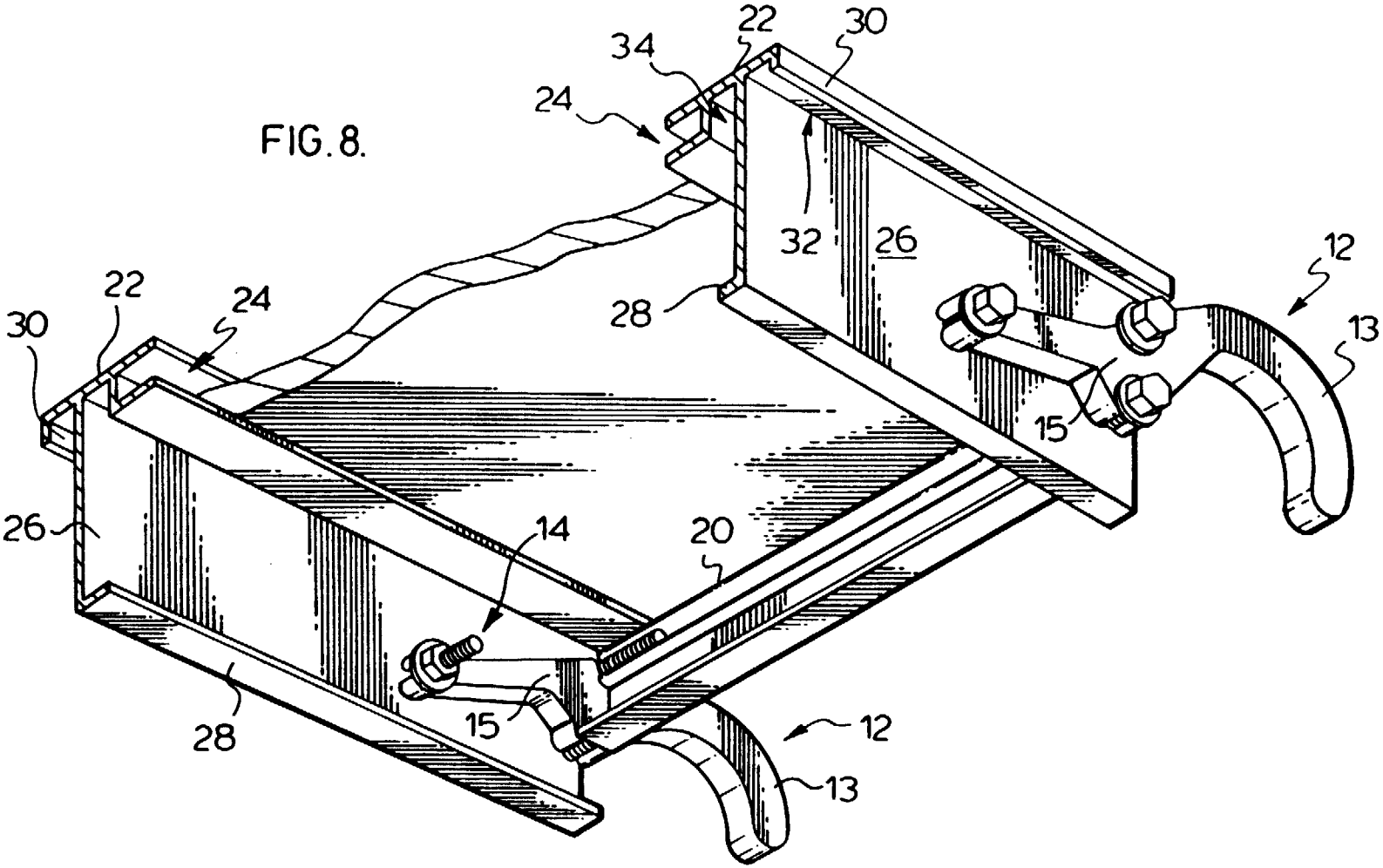
FIG. 8 is a partial perspective view of one end of the scaffold deck.

The transom member 10, as shown in FIGS. 4 and 8, has a vertical extending flange 46 for securing and protecting the end of the plywood 40 with the upper bolt engaging slot 20 being positioned to provide bottom support for the lower flange of the substrate receiving slot 24. A web 48 interconnects the bolt engaging slots 22 and has a perpendicularly extending bottom flange 50. As can be seen in FIG. 8, the bottom flange 50 generally corresponds with the lower port 18 provided in the hook members 12.

As shown in FIG. 4, each side rail 8 at one end includes a hook member to one side of the web 26 and at the other end includes the hook member to the opposite side of the web. When the hook member is located to the interior of the web 26, the hook member is trapped between the side rail and the associated end of the transom member 10 with the bolts passing first through the side rails, subsequently through the ports in the hook member for receipt in the bolt receiving slots 20 of the transom in case of two of the bolts and in case of the third bolt for engagement with a nut 38. At the opposite end of the side rail, the hook member is to the exterior such that the bolt fasteners pass through the hook member first, through the side rail and subsequently engage the respective transom member. The intermediate member 42 can be in the form of a transom member with the vertical flange 46 removed. Thus, bolt fasteners can pass through the side rails and be received in bolt engaging and receiving slots 20.

Figure 6:
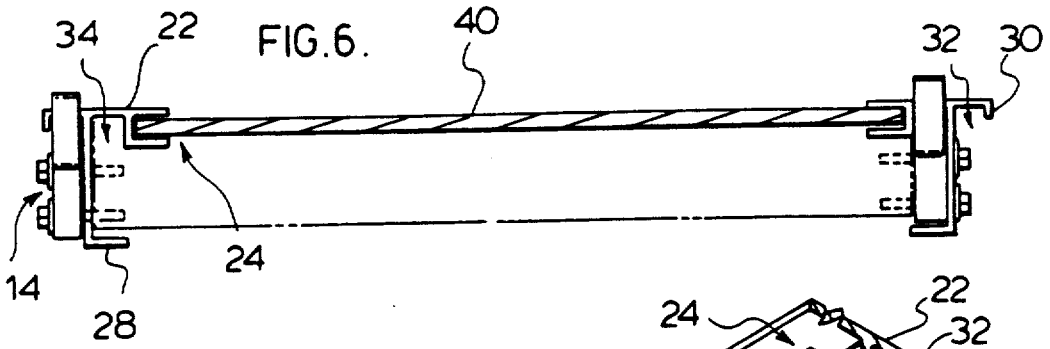
FIG. 6 is an end view of the scaffold deck with one transom member removed for clarity.

FIGS. 6 and 7 illustrate how the sheet of plywood 40 does not extend to the outer edge of the side rail and, in fact, the width of the substrate has been reduced by the distance between outer flange 30 and the back of the substrate receiving slot 24. Thus, the side rail has been made of a particular shape to utilize the structural strength of the side rail to provide a work surface at the top edge strip 22 and to reduce the weight of the structure by limiting the width of the plywood substrate 40. With this scaffolding arrangement, it can be appreciated that the plywood substrate 40 is trapped within slot 24 and cannot move beyond the transom members due to the vertical flange 46. The members are secured in place by the common fasteners 14.

The hook members 12, as shown in FIG. 8, include a rail engaging portion 13 which is positioned beyond the end of the transom member by means of the leg portion 15 which has therein the various ports 18 for receiving the common fasteners 14. The 3-point securement of the leg 15 to the end of the scaffold deck provides a very strong mechanical connection while also serving to maintain the components in their desired configuration.

It has been found with this scaffold deck that improved strength and stiffness has been achieved while reducing the weight and reducing the overall cost of the system. It can seen that the side rails have been shaped to provide excellent strength with respect to downward deflection and are a depth of about four inches. The plywood substrate has been limited to the area intermediate the side rails and the amount of overlap of the plywood with the side rails has been limited to an area to provide effective load transfer therebetween. It has been recognized that a high degree of overlap is not essential to provide adequate rigidity at the side rails.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A scaffold deck comprising two parallel extruded rails, said side rails at opposed interior edges of the side rails each including a substrate engaging slot terminating at a position spaced and inwardly offset from a downwardly extending web of the side rail, said slot extending in the length of the side rail; and a substrate engaged by said slots and extending between said side rails, said side rails beyond said substrate engaging slot including a top edge strip extending in the length of each side rail which in combination with the engaged substrate form the top surface of the scaffold deck whereby the top edge strip is to either side of said downwardly extending web and forms the majority of a top surface of the respective side rail.

2. A scaffold deck as claimed in claim 1 including transom members at either end of said side rails connecting said side rails.

3. A scaffold deck as claimed in claim 2 wherein each transom member includes a lip at the upper edge thereof which serves to contain said substrate between said transom members and between said side rails.

4. A scaffold deck as claimed in claim 2 including a hook member at the junction of each transom member and side rail which are commonly secured by fasteners.

5. A scaffold deck as claimed in claim 4 wherein said transom members each include two bolt engaging recesses at each end of the transom member into which said common fasteners engage.

6. A scaffold deck as claimed in claim 1 wherein the top edge strip of each side rail has the surface thereof raised to improve foot traction thereon.

7. A scaffold deck as claimed in claim 6 wherein said raised surface is ribbed.

8. A scaffold deck as claimed in claim 1 wherein the top surface of the slot forms part of said side rail edge strip.

9. A scaffold deck as claimed in claim 3 wherein said web is perpendicular to said edge rail strip.

10. A scaffold deck as claimed in claim 3 wherein said transom member includes bolt engaging slots running the length of the transom member which receive and engage the common fasteners used to secure the side rail, hook member, and the transom at each corner of the scaffold deck.

11. A scaffold deck as claimed in claim 10 wherein each hook and side rail has two ports aligned with two bolt engaging slots of the respective transom and said common fastener are bolts engaged by said two bolt engaging slots.

12. A scaffold deck as claimed in claim 11 wherein each hook and side rail have common aligned ports spaced from said transom which are maintained in alignment and engaged by a common fastener.

13. A scaffold deck as claimed in claim 12 wherein said web is disposed beneath said side rail edge strip and said side rail edge strip is of a width to accommodate within the width of said side rail edge strip the thickness of a hook member to either side of said web.

14. A scaffold deck as claimed in claim 13 wherein said substrate engaging slot of each side rail is spaced from said web a distance to accommodate the thickness of a hook member intermediate said slot and said web.

15. A scaffold deck as claimed in claim 14 wherein said transom members include a lip to protect the end of said substrate received in said slots of said side rails.

16. A scaffold deck as claimed in claim 1 wherein at either side of the scaffold deck said top surface beyond said substrate receiving slot is of a width of at least one inch.

17. A scaffold deck as claimed in claim 1 wherein said substrate engaging slot terminates a spaced distance form said downwardly extending web sufficient to accommodate a securing portion of a hook member used to secure said scaffold deck to a supporting structure.

18. A scaffold deck as claimed in claim 17 including scaffold securing hooks attached at each end of each side rail with two of said hooks to the outside of said web and two hooks to the interior surface of said web member between said web member and said slot for receiving said substrate.

19. A scaffold deck as claimed in claim 18 wherein said hooks, said respective side rail members, and said respective transom member are secured by common fasteners passing through the respective hook and side rail and terminating in said transom member.

* * * * *